US012410708B2

(12) United States Patent
Duthie et al.

(10) Patent No.: US 12,410,708 B2
(45) **Date of Patent: *Sep. 9, 2025**

(54) WELL TESTING METHOD USING TUBING HANGER DEPLOYED APPARATUS

(71) Applicant: SAUDI ARABIAN OIL COMPANY, Dhahran (SA)

(72) Inventors: Laurie S. Duthie, Ras Tanura (SA); Mubarak Dhufairi, Manifa (SA); Abdulaziz A. Al-Anizi, Manifa (SA); Hussain A. Saiood, Ras Tanura (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 208 days.

This patent is subject to a terminal disclaimer.

(21) Appl. No.: 18/059,931

(22) Filed: Nov. 29, 2022

(65) Prior Publication Data

US 2024/0175354 A1 May 30, 2024

(51) Int. Cl.
*E21B 49/08* (2006.01)
*E21B 33/04* (2006.01)

(52) U.S. Cl.
CPC ..... *E21B 49/087* (2013.01); *E21B 33/04* (2013.01)

(58) Field of Classification Search
CPC ..... E21B 49/087; E21B 33/04
See application file for complete search history.

(56) References Cited

U.S. PATENT DOCUMENTS 2,962,895 A 12/1960 Rumble
3,193,005 A 7/1965 Hunter et al.
5,284,208 A 2/1994 Clemens et al.
6,920,395 B2 7/2005 Brown
8,539,976 B1 9/2013 Rodgers et al.
10,494,921 B2 12/2019 Weng et al.
2004/0006429 A1 1/2004 Brown
(Continued)

FOREIGN PATENT DOCUMENTS

CA 1041007 A 10/1978
CA 3150064 A1 3/2021
(Continued)

OTHER PUBLICATIONS

"Tubing Hanger," Nov. 28, 2022; pp. 1-2; Retrieved from the Internet: URL: http://www.ccscpetro.com/tubing_hanger.html (2 pages).

*Primary Examiner* — Giovanna Wright

(74) *Attorney, Agent, or Firm* — Osha Bergman Watanabe & Burton LLP

(57) ABSTRACT

Systems and a method for well testing using a tubing hanger deployed apparatus are disclosed. The method includes shutting in a well and connecting a pressure control system and a tool string to an adapted tubing hanger plug; installing the pressure control system, the tool string, and the adapted tubing hanger plug into a borehole; opening the borehole for a fluid flow; measuring a flow rate of the fluid flow through the borehole using a flowmeter; and measuring physical properties of the fluid flow with sensors on the tool string. The method further includes closing a surface safety valve and optionally closing a subsurface safety valve; retrieving the adapted tubing hanger plug and the tool string; and downloading data for analysis of the flow rate and physical properties measured.

19 Claims, 6 Drawing Sheets

(56) References Cited

U.S. PATENT DOCUMENTS

| | | | | |
|---|---|---|---|---|
| 2007/0044960 | A1* | 3/2007 | Lovell | E21B 43/122 166/250.07 |
| 2008/0083533 | A1* | 4/2008 | Malone | E21B 34/14 166/381 |
| 2008/0307891 | A1* | 12/2008 | Raskie | G01F 15/08 73/32 R |
| 2011/0100112 | A1 | 5/2011 | Du | |
| 2011/0198087 | A1* | 8/2011 | Adam | E21B 7/18 166/308.1 |
| 2015/0240628 | A1* | 8/2015 | Purkis | E21B 47/26 166/373 |
| 2016/0265341 | A1 | 9/2016 | Subervie et al. | |
| 2021/0293140 | A1* | 9/2021 | Brown | E21B 43/128 |
| 2021/0372243 | A1* | 12/2021 | Arukhe | F03G 7/122 |
| 2024/0218785 | A1* | 7/2024 | Duthie | E21B 47/10 |

FOREIGN PATENT DOCUMENTS

| | | | |
|---|---|---|---|
| CN | 1079488 | A | 12/1993 |
| CN | 101358525 | A | 2/2009 |
| CN | 102797454 | A | 11/2012 |
| CN | 205558885 | U | 9/2016 |
| CN | 205622279 | U | 10/2016 |
| CN | 207623000 | U | 7/2018 |
| CN | 108361025 | A | 8/2018 |
| CN | 207715140 | U | 8/2018 |
| CN | 110056325 | A | 7/2019 |
| CN | 111379538 | A | 7/2020 |
| CN | 213116281 | U | 5/2021 |

* cited by examiner

WELL TESTING METHOD USING TUBING HANGER DEPLOYED APPARATUS

BACKGROUND

Production monitoring is a key component of any strategy to manage an oil and gas field. Well testing is necessary to assess the potential of the reservoir under dynamic conditions and is a key part of the production monitoring.

Conducting surface well testing requires a large amount of equipment, available space, and a large crew to operate the equipment. For some reservoir conditions, such as tight emulsions of water and oil, extra equipment and chemicals are required to break the emulsion, thus requiring the equivalent to a small production plant. Due to the cost inefficiencies of the traditional approach, an alternative method for testing reservoir fluids that uses minimal equipment and manpower would be useful.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments disclosed herein relate to systems and a method for well testing using a tubing hanger deployed apparatus. The method includes shutting in a well and connecting a pressure control system and a tool string to an adapted tubing hanger plug; installing the pressure control system, the tool string, and the adapted tubing hanger plug into a borehole; opening the borehole for a fluid flow; measuring a flow rate of the fluid flow through the borehole using a flowmeter; and measuring physical properties of the fluid flow with sensors on the tool string. The method further includes closing a surface safety valve and optionally closing a subsurface safety valve; retrieving the adapted tubing hanger plug and the tool string; and downloading data for analysis of the flow rate and physical properties measured.

In general, in one aspect, embodiments disclosed herein relate to a system for a tubing hanger deployed apparatus. The system includes an adapted tubing hanger plug configured to allow flow through of fluids from a borehole to a surface; a flowmeter configured to measure a flow rate of a fluid in the borehole; a pressure control system configured to prevent an uncontrolled flow of liquids from the borehole; and a tool string configured to carry sensors into the borehole. The system further includes a plurality of sensors configured to measure pressure data, temperature data, fluid density data, and fluid phase data; a memory section configured to record the pressure data, the temperature data, the fluid density data, and the fluid phase data; and an electronics section configured to control sensor measurement and recording operations.

Other aspects and advantages of the claimed subject matter will be apparent from the following description and the appended claims.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In one aspect, embodiments disclosed herein relate to a method and systems for surface well testing to assess the production potential of a reservoir under dynamic conditions. The method and systems measure the flow rate in an oil producing well using a combination of sensors deployed in a production tubing hanger profile near the surface. A standard plug is adapted to allow full flow through it and is set in the tubing hanger with a tool string attached below it. The tool string includes sensors that measure flow rate and quantifies the phases of water, oil, and gas; sensors also measure pressure, temperature, fluid density, and identify fluids in order to determine the water cut. Due to the set up as disclosed herein, no wireline or coiled tubing is necessary. The purpose of embodiments disclosed herein is to measure the total flow and water cut for a producing well with higher accuracy than conventional well test equipment, in the production tubing hanger profile near the surface, and to replace the requirement for a surface well testing package. In one or more embodiments, the method of setting flowmeter tools in a tubing hanger profile removes the requirement to separate the phases, and the total flow and water cut are measured in-situ.

Figure 1A:
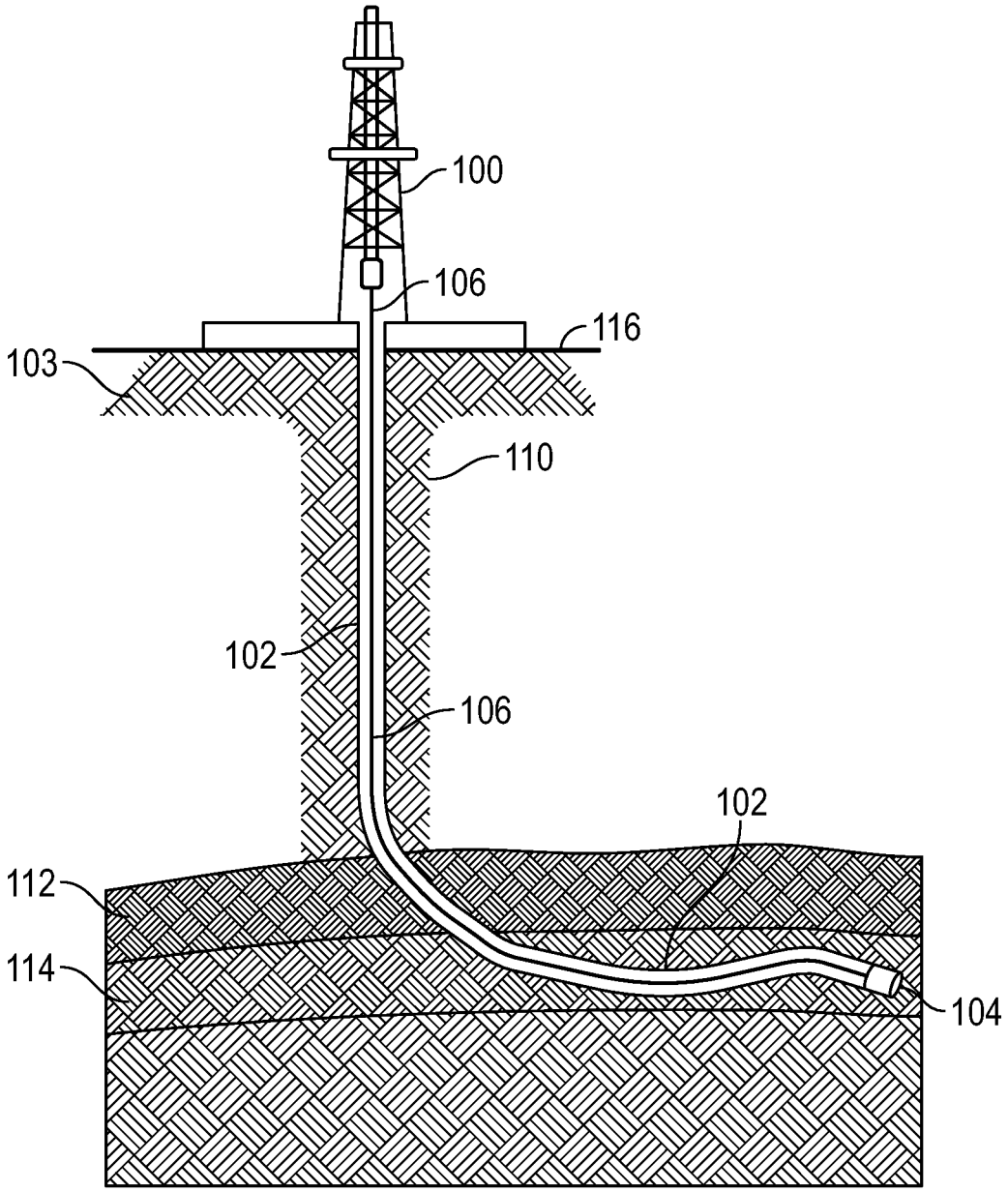
FIG. 1A shows, in one or more embodiments, a drilling system.

FIG. 1A illustrates systems in accordance with one or more embodiments. Specifically, FIG. 1A shows a well (102) that may be drilled into the subsurface (103) by a drill bit (104) attached by a drillstring (106) to a drill rig (100) located on the Earth's surface (116). The borehole (108) corresponds to the uncased portion of the well (102). The borehole trajectory is the path in three-dimensional space that the well (102) is drilled through the subsurface (103). The borehole (108) of the well (102) may traverse a plurality of overburden layers (110) and one or more cap-rock layers (112) to a hydrocarbon reservoir (114). The curved well path of the drillstring (106) may be planned based, at least in part, on a seismic image or other remote sensing data.

Tool strings (126) contain sensors and are lowered into boreholes (108) in the oil and gas industry for a variety of reasons, including to perform well logging, remediation, etc. The tool string (126) is inserted and retrieved from the borehole (108) with a line. The sensors usually require power while in the borehole (108) to perform their functions. This power may come from a variety of sources (e.g., electrical, mechanical, battery, etc.). Wireline is an electrically conductive cable usually comprising helically twisted wires surrounding an insulated conductive core. Electrical power may be passed along wireline from the surface (116) to the sensor. The wireline may also be used for communication between the surface (116) and the sensor in the borehole (108). Alternatively, a winch at the surface (116) may generate mechanical power and transmit it down the borehole (108) through steel cables known as slicklines. However, slicklines are normally not configured to deliver electrical power. Therefore, when using slickline, power for sensors in the borehole (108) is usually provided by batteries. Coiled tubing, a continuous length of pipe wound on a spool, is widely used in place of slickline or wireline in the case of a highly deviated or horizontal well (102). The coiled tubing is forced through the borehole (108) to access the targeted interval.

Figure 1B:
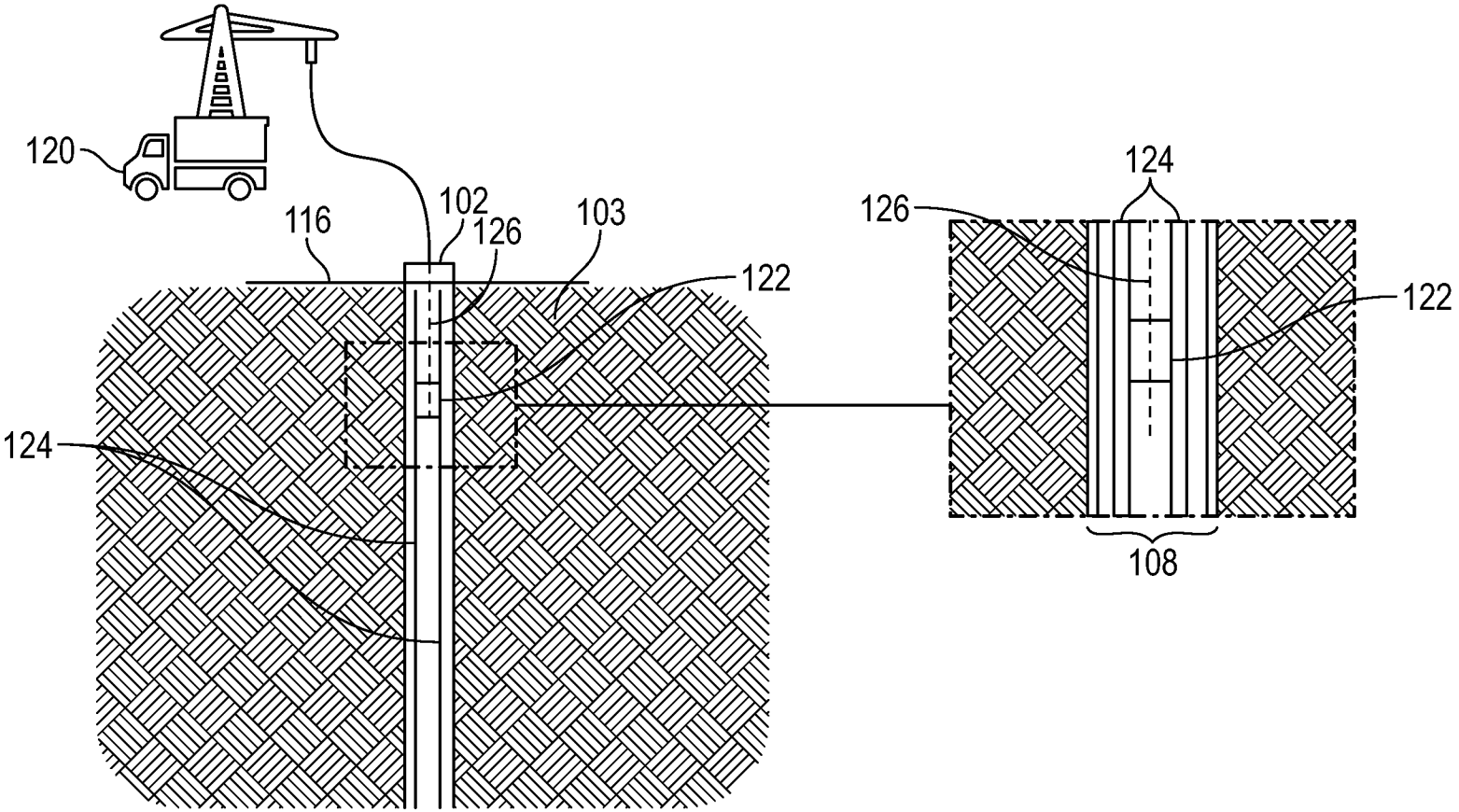
FIG. 1B shows, in one or more embodiments, a tubing hanger deployed apparatus with a plug in a borehole.

FIG. 1B illustrates systems in accordance with one or more embodiments. Specifically, FIG. 1B shows the top portion of the well (102) from FIG. 1A that has been drilled into the subsurface (103). Casing (124) is pipe that may be lowered into a borehole (108) and is designed to resist compressive and tensile stresses in the subsurface (103). A plug (122) is a device that isolates the well (102) to perform a pressure test. For the systems and method disclosed herein, the plug (122) may be installed near the surface (116) of the borehole (108), but is not limited to this location and may be disposed in any suitable location for plugging the well (102).

Once production of hydrocarbons has begun, the methods to evaluate fluid properties in a well (102) include pumping well tests, transient-pressure tests, and buildup tests; these methods are used to determine rock properties and formation limits. Pumping well tests may be achieved with a pressure gauge lowered into the borehole (108) and usually requires monitoring the rise in fluid level and calculating the bottomhole pressure by assuming a fluid density. Transient pressure tests look at the pressure in the borehole (108) near the productive interval after the flow rate of the well (102) is changed. Buildup tests measure bottomhole pressure data acquired after a producing well (102) is shut in and are the preferred means to determine well flow capacity, permeability thickness, skin effect, and other information.

Figure 2A:
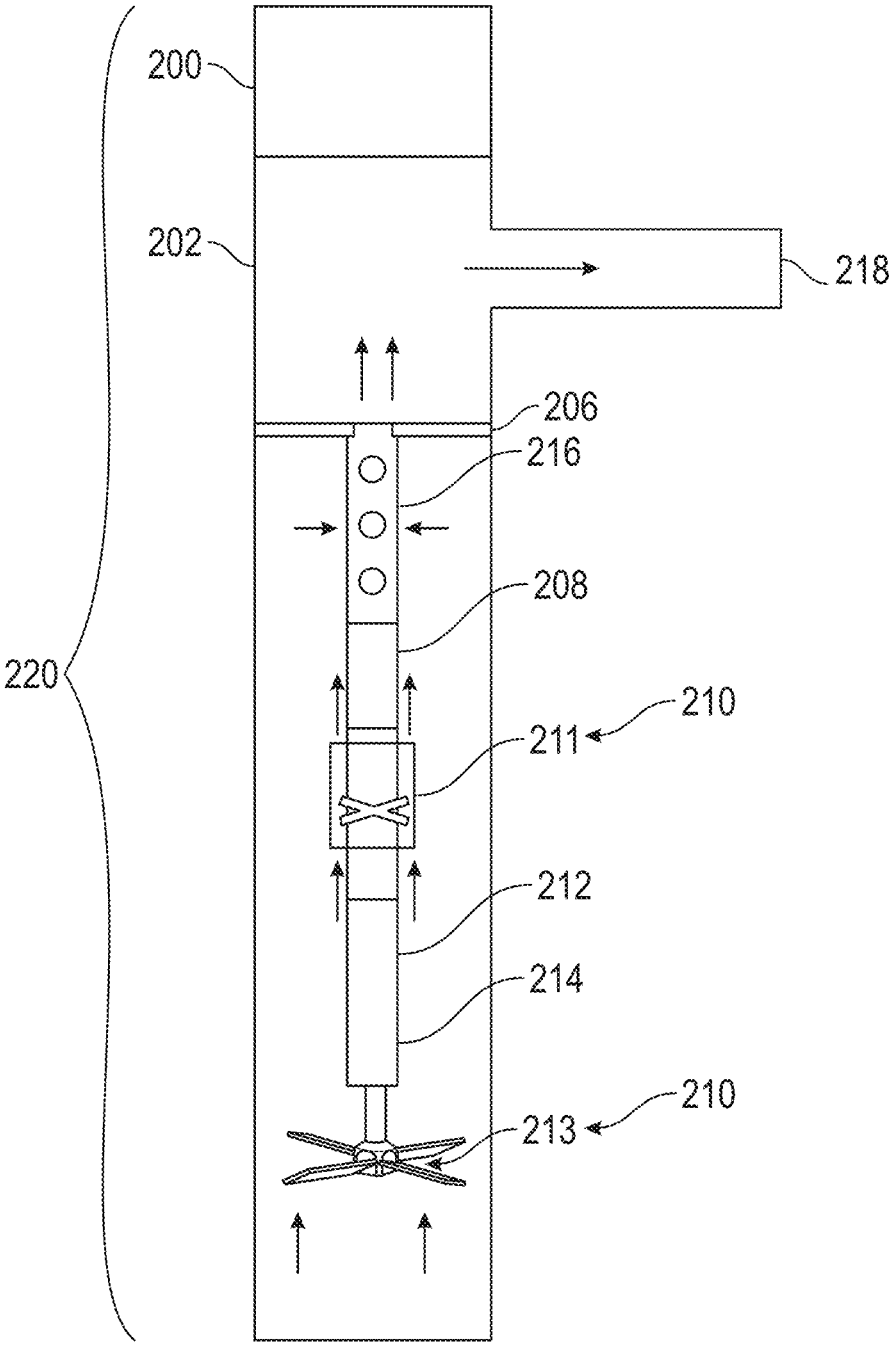
FIG. 2A shows, in one or more embodiments, a tubing hanger deployed apparatus.

The method and systems presented herein offer an alternative to the traditional methods of well testing and require no wireline or coiled tubing units. Specifically, in one or more embodiments, FIG. 2A shows the layout of a tubing hanger deployed apparatus (220). The apparatus's main components are an adapted tubing hanger plug (206), a battery pack (208), memory section (212), electronics section (214), and a flowmeter (210). Each of these components of the tubing hanger deployed apparatus (220) is discussed in detail below.

An adapted valve is used to hang a tool string (126) in the borehole (108). The tool string (126) is lowered through the pressure control system (200) on a rod and screwed into the production tubing hanger profile. The production tubing hanger profile is a suite of equipment typically installed near the wellhead that is used to support a tubing string lowered into a borehole. A truck-mounted crane (120) may be used to hang the tool string (126). This system provides an advantage in terms of ease of deployment, reduced onsite footprint, requires less personnel to operate the equipment, and has a lower overall cost. The pressure control system (200) prevents the uncontrolled flow of liquids and gases from a borehole (108) during well (102) drilling or production operations.

There are many situations where this type of measurement will provide a more accurate rate measurement than other methods. For instance, when measuring flow rates in a deviated or horizontal borehole (108) the phases may segregate, with the heavier phase on the lower side and lighter phases on the upper side of the borehole (108). This makes it more difficult to accurately assess the flow rate. Since the flowmeter (210) as used in this invention is located near the surface (116), it will be in a vertical position and the phases will be naturally mixed in turbulent flow, thus avoiding the problem.

Another example is where the gas/oil ratio is low and tight emulsions are present that cannot be separated using a standard surface well testing package. In this case, it is difficult to separate and measure the low gas content, as well as separate the oil and water phases from the tight emulsion, and can lead to erroneous rate measurements. The deployment of a flowmeter (210) inside the well (102) again will more accurately measure the flow rates and water cut because it does not require the phases to be separated.

If the fluids are in a single phase condition (with pressure above the bubble point), this method will perform even more accurately. Water cut results from the installed toolstring (210) can be confirmed through surface fluid sampling.

Calibration of the flowmeter (210) is done outside the borehole (108) prior to use. The flowmeter (210) is run in combination with other sensors to measure pressure, temperature, fluid type, and fluid density and thereby determine the water cut. Tubing hangers can have a profile which can be used to set plugs (122), to isolate the well (102), or to pressure test the production tree (202). This profile can also be used to set the flowmeter (210). This is done using the pressure control system (200) atop the production tree (202) along with mechanical tools to set the plug (122); in this case, no wireline is used. A standard plug (122) is adapted to allow full flow through it and set in the tubing hanger with the tool string (126) attached below.

The adapted tubing hanger plug (206) is a standard plug (122) for tubing hanger applications that has been adapted to allow for full flow through it. The adapted tubing hanger plug (206) has a centralized through-hole to allow full flow with a perforated joint (216) connected below the adapted tubing hanger plug and above the tool string (126).

The battery pack (208) includes one or more batteries to power the sensors. The choice of the batteries may be adjusted depending on the temperature and duration of the test. This device could also be supplied with power from the surface (116) with an electrical cable passing through the surface pressure control system (200).

The memory section (212) of the apparatus provides storage for the data from the flowmeter (210) test. This device may also be run in real time via power and data cables going back to surface (116). Due to close proximity of the equipment to the surface (116), wireless options are also feasible for real time communications between the memory section (212) and a surface facility.

The electronics section (214) contains the programmable controller for all sensor operations, including the sampling frequency for each sensor and the duration of its operation.

Sensors attached to the electronics section (214) may include the following: a temperature sensor, a pressure gauge, fluid density sensor, and a fluid identification sensor that identifies fluid phases. The fluid density sensor may use pressure/volume/temperature (PVT) data obtained from a pressurized sample and analyzed in a laboratory to determine properties such as density of oil, gas, and water, the gas-oil-ratio, etc.

The invention is not limited to these sensors. Any other sensor that measures physical, chemical, or other properties of the fluid in the borehole (108) may be added to the array of sensors in the electronics section (214).

Continuing with FIG. 2A, the flowmeter (210) has a primary fullbore spinner (213) and a secondary inline spinner (211) with a smaller blade size. A pick-up measures each rotation that is caused by the mechanical energy of the fluid rotating the spinner blades. The rotations are measured and calculated to provide a proportional measurement relative to the flow rate. The relationship between the spinner blades and flow rate is well known to a person of ordinary skill in the art. Using the largest possible fullbore spinner blade that fits the pipe captures most of the flow in the borehole (108), thus reducing uncertainty producing a more accurate result. The inline spinner (211) with a smaller blade may return a less accurate rate but its data may be relied upon as a secondary verification.

Figure 2B:
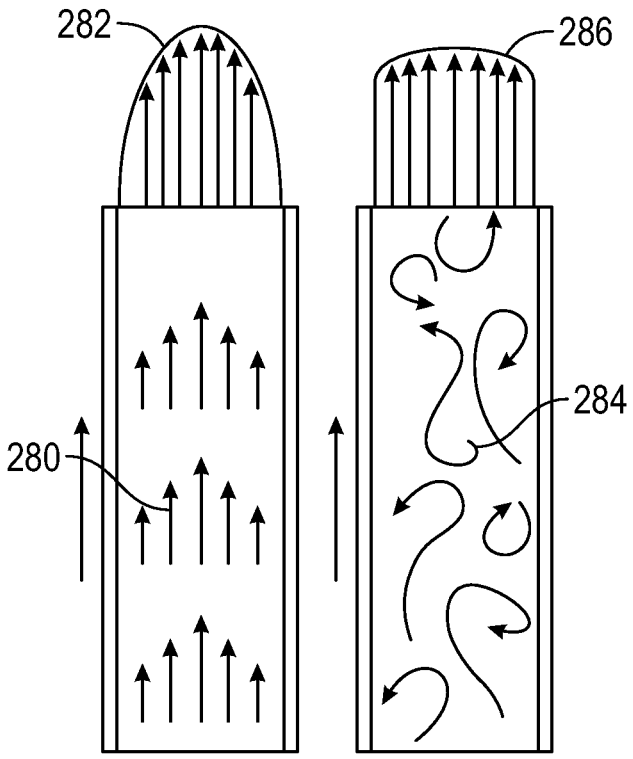
FIG. 2B shows, in one or more embodiments, laminar and turbulent flow.

As shown in FIG. 2B, under flowing conditions, the flow may be either laminar in the case of low energy environment, or turbulent in the case of a high energy environment. For laminar flow (280), the shape of the velocity profile versus the hole diameter is parabolic (282), with the center of the borehole (108) having the highest velocity. For turbulent flow (284), the velocity profile versus distance from center of the borehole (108) is much flatter (286), with the highest velocity still in the center but much closer to the average velocity throughout.

Both the centralized inline spinner (211) and the fullbore spinner (213) therefore read closer to average velocity in a turbulent flow (284) regime. The fullbore spinner (213), covering a larger cross sectional area (CSA), would be more accurate, especially in laminar flow (280). For either laminar flow (280) or turbulent flow (284), a factor must be applied to correct for the non-uniform nature of the fluid velocity flowing along the open hole. The calibration of the flowmeter (210) for a known size of borehole (108) size will allow for accurate calculated flow rates.

A volumetric flow rate of hydrocarbons produced at the surface (116) of the well (102) is calculated as follows:

$$Q=CSA\times V_{av}$$

where Q is the volumetric flow rate in reservoir barrels per day (RBPD), CSA is the cross sectional area (calculated from a pipe's inner diameter), and $V_{av}$ is the average fluid velocity in feet per minute (FPM). $V_{av}$, is, in turn, calculated by applying a correction factor to $V_{app}$, the apparent fluid velocity (also in FPM):

$$V_{av}=V_{app}\times Cf$$

Figure 2C:
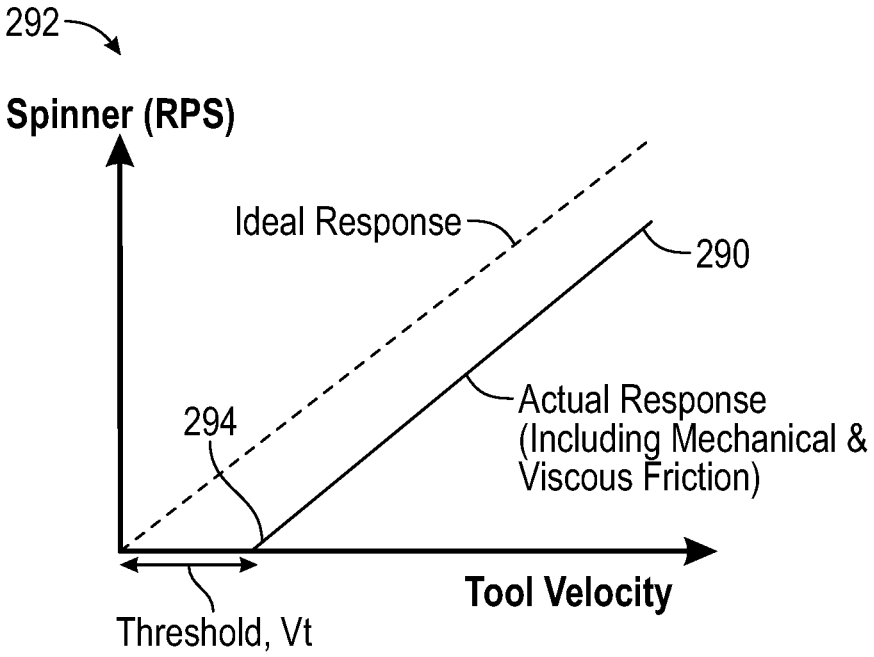
FIG. 2C shows, in one or more embodiments, spinner speed versus tool velocity.

Here, $Cf$ is a correction factor that accounts for a non-uniform shape of the velocity profile as shown in FIG. 2B, and is unitless. The correction factor is empirically determined and is usually in the range of 0.8 to 0.9 for a turbulent flow (284) regime, which is the most common flow regime for flowing wells. Computer modelling can be used to estimate this correction factor and calculate the flow rate. To be able to convert the spinner speed for either the fullbore spinner (213) or the inline spinner (211) to $V_{app}$, a calibration must be incorporated through the following equation:

$$V_{app}=\frac{\text{Spin}}{m}-V_t,$$

where Spin is the spinner's speed in revolutions per second (RPS), and m is the inverse of the slope (290) in a plot of Tool Velocity versus Spin (292), as shown in FIG. 2C. m is obtained from calibrating the spinner's response (RPS/FPM) and determined by the intersect of the x-axis in a no flow condition (294). The threshold velocity, $V_t$ (in FPM), is the minimum fluid velocity required to start the spinner turning to overcome friction forces in a fluid; the spinner response calibrates for the specific fluid type viscosity and mechanical friction, both of which affect the response of the spinner.

Single phase flow is the simplest flow regime to measure without the complexities that exist in multi-phase flow; fluid viscosities and densities remain constant leading to linear spinner responses. All spinner calibration is completed in a laboratory using as close to actual conditions as possible.

Figure 3:
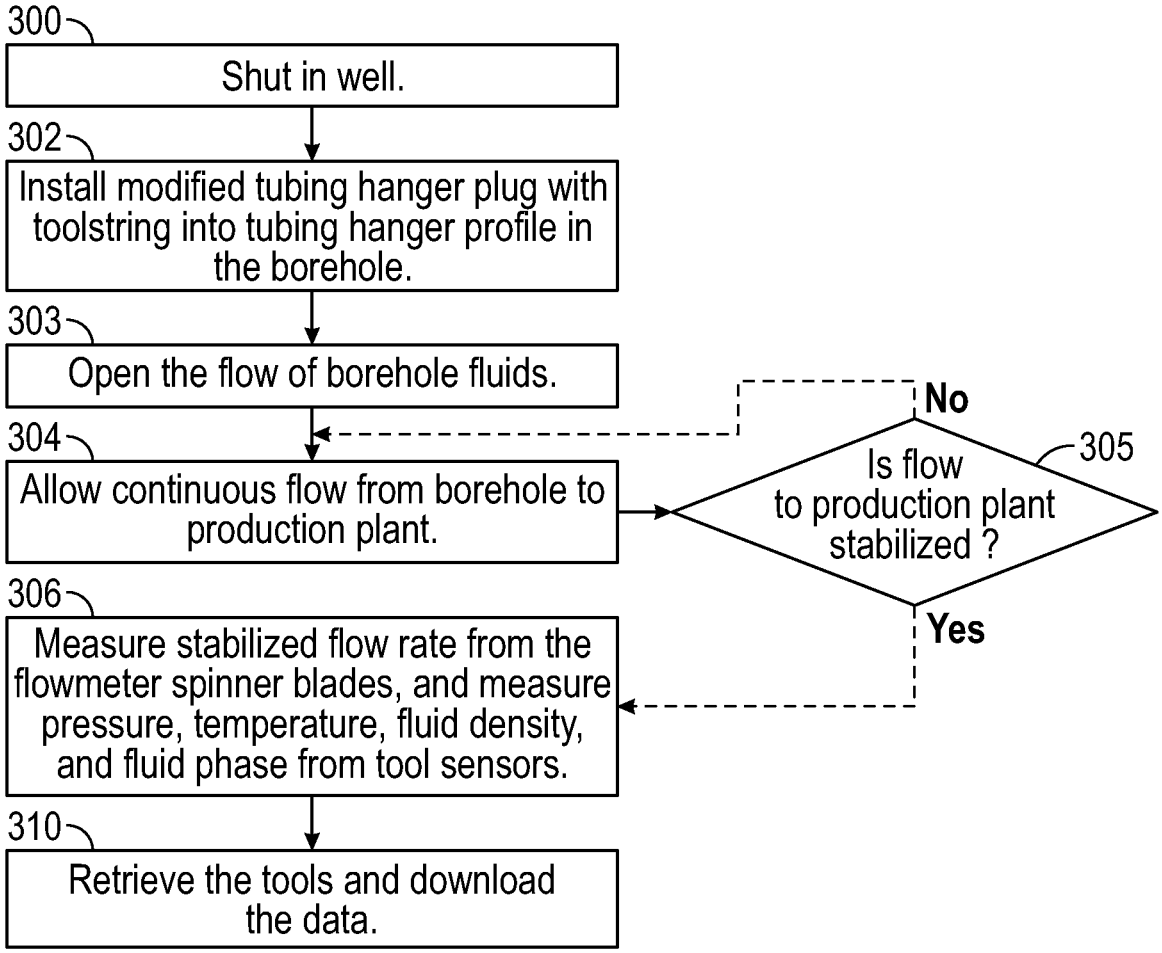
FIG. 3 shows a workflow according to one or more embodiments.

FIG. 3 presents a workflow for the method disclosed herein. In Step 300, a well (102) is shut in. A pressure control system (200) and a tool string (126) are then connected to an adapted tubing hanger plug (206) outside of the borehole (108). The adapted tubing hanger plug (206) has a perforated joint (216) installed in it through which fluid can flow. In Step 302, the adapted tubing hanger plug (206) and the connected tool string (126) are installed in the tubing hanger profile in the borehole (108). In Step 303, the well (102) is opened through surface valves (218) to allow the borehole fluids to flow to surface (108).

In Step 304, fluid flows continuously out of the borehole (108) to a surface (116) production plant. The operator waits until the flow rate stabilizes. In Step 305, the operator checks whether the flow rate has stabilized. If the flow rate has not stabilized, Step 304 is repeated and the operator lets the flow continue from the borehole (108) to the production plant, and rechecks (Step 305) to see if the flow has stabilized. Once the flow rate has stabilized, the method proceeds to Step 306, where the stabilized flow rate is measured using a primary fullbore spinner (213) and a secondary inline spinner (211). Furthermore, in Step 306, sensors in the tool string (126) simultaneously measure pressure, temperature, water cut, and other physical variables. In Step 310, tools are retrieved from the well (102). If sensor data and spinner rates for the fullbore spinner (213) and secondary inline spinner (211) were recorded on the memory section (212) instead of being recorded live through cables or wireless connections, those data are retrieved from the memory section (212) and downloaded for analysis. Analysis may include post processing spinner rate, pressure, temperature, and water cut data to remove noise as well as outliers caused by faulty equipment.

Figure 4:
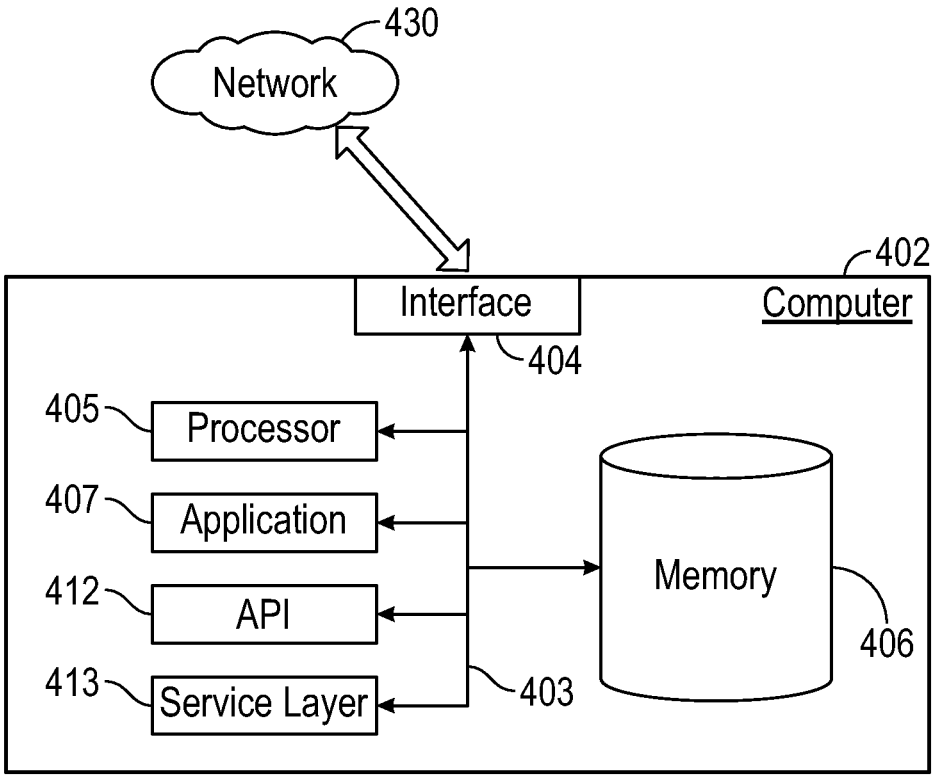
FIG. 4 shows a computer system according to one or more embodiments.

FIG. 4 depicts a block diagram of a computer system (402) used to provide computational functionalities associated with described algorithms, methods, functions, processes, flows, and procedures as described in this disclosure, according to one or more embodiments. In particular, the computer system (402) as used herein provides computation functionality for operating a surface (116) pressure control system (200), a flowmeter (210), a memory section (212), and an electronics section (214), including attached sensors. The computer system may also be used to process, analyze, and display the measurement data from the sensors that measure the fluid flow in the wellbore.

The illustrated computer (402) is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (402) may include a computer that includes an input device, such as a keypad, keyboard, touch screen, or other device that can accept user information, and an output device that conveys information associated with the operation of the computer (402), including digital data, visual, or audio information (or a combination of information), or a GUI.

The computer (402) can serve in a role as a client, network component, a server, a database or other persistency, or any other component (or a combination of roles) of a computer system for performing the subject matter described in the instant disclosure. The illustrated computer (402) is communicably coupled with a network (430). In some implementations, one or more components of the computer (402) may be configured to operate within environments, including cloud-computing-based, local, global, or other environment (or a combination of environments).

At a high level, the computer (402) is an electronic computing device operable to receive, transmit, process, store, or manage data and information associated with the described subject matter. According to some implementations, the computer (402) may also include or be communicably coupled with an application server, e-mail server, web server, caching server, streaming data server, business intelligence (BI) server, or other server (or a combination of servers).

The computer (402) can receive requests over network (430) from a client application (for example, executing on another computer (402) and responding to the received requests by processing the said requests in an appropriate software application. In addition, requests may also be sent to the computer (402) from internal users (for example, from a command console or by other appropriate access method), external or third-parties, other automated applications, as well as any other appropriate entities, individuals, systems, or computers.

Each of the components of the computer (402) can communicate using a system bus (403). In some implementations, any or all of the components of the computer (402), both hardware or software (or a combination of hardware and software), may interface with each other or the interface (404) (or a combination of both) over the system bus (403) using an application programming interface (API) (412) or a service layer (413) (or a combination of the API (412) and service layer (413). The API (412) may include specifications for routines, data structures, and object classes. The API (412) may be either computer-language independent or dependent and refer to a complete interface, a single function, or even a set of APIs. The service layer (413) provides software services to the computer (402) or other components (whether or not illustrated) that are communicably coupled to the computer (402). The functionality of the computer (402) may be accessible for all service consumers using this service layer. Software services, such as those provided by the service layer (413), provide reusable, defined business functionalities through a defined interface. For example, the interface may be software written in JAVA, C++, or other suitable language providing data in extensible markup language (XML) format or another suitable format. While illustrated as an integrated component of the computer (402), alternative implementations may illustrate the API (412) or the service layer (413) as stand-alone components in relation to other components of the computer (402) or other components (whether or not illustrated) that are communicably coupled to the computer (402). Moreover, any or all parts of the API (412) or the service layer (413) may be implemented as child or sub-modules of another software module, enterprise application, or hardware module without departing from the scope of this disclosure.

The computer (402) includes an interface (404). Although illustrated as a single interface (404) in FIG. 4, two or more interfaces (404) may be used according to particular needs, desires, or particular implementations of the computer (402). The interface (404) is used by the computer (402) for communicating with other systems in a distributed environment that are connected to the network (430). Generally, the interface (404) includes logic encoded in software or hardware (or a combination of software and hardware) and operable to communicate with the network (430). More specifically, the interface (404) may include software supporting one or more communication protocols associated with communications such that the network (430) or interface's hardware is operable to communicate physical signals within and outside of the illustrated computer (402).

The computer (402) includes at least one computer processor (405). Although illustrated as a single computer processor (405) in FIG. 4, two or more processors may be used according to particular needs, desires, or particular implementations of the computer (402). Generally, the computer processor (405) executes instructions and manipulates data to perform the operations of the computer (402) and any algorithms, methods, functions, processes, flows, and procedures as described in the instant disclosure.

The computer (402) also includes a memory (406) that holds data for the computer (402) or other components (or a combination of both) that can be connected to the network (430). For example, memory (406) can be a database storing data consistent with this disclosure. Although illustrated as a single memory (406) in FIG. 4, two or more memories may be used according to particular needs, desires, or particular implementations of the computer (402) and the described functionality. While memory (406) is illustrated as an integral component of the computer (402), in alternative implementations, memory (406) can be external to the computer (402).

The application (407) is an algorithmic software engine providing functionality according to particular needs, desires, or particular implementations of the computer (402), particularly with respect to functionality described in this disclosure. For example, application (407) can serve as one or more components, modules, applications, etc. Further, although illustrated as a single application (407), the application (407) may be implemented as multiple applications (407) on the computer (402). In addition, although illustrated as integral to the computer (402), in alternative implementations, the application (407) can be external to the computer (402).

There may be any number of computers (402) associated with, or external to, a computer system containing computer (402), wherein each computer (402) communicates over network (430). Further, the term "client," "user," and other appropriate terminology may be used interchangeably as appropriate without departing from the scope of this disclosure. Moreover, this disclosure contemplates that many users may use one computer (402), or that one user may use multiple computers (402).

Embodiments disclosed herein provide an apparatus and method for conducting portable testing to measure fluid flow rates and cross check multi-phase flow meter calibrations. Well testing to capture the production rates is an integral and key part of the production monitoring. Embodiments disclosed herein can be used to verify the readings of any multi-phase flow meters that may be installed. The main application as disclosed herein is a way to optimize measurement of fluid rates. Testing using the apparatus disclosed herein would be particularly suitable for tight emulsions that are difficult to break with conventional surface well testing equipment.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A method for well testing using a tubing hanger deployed apparatus, comprising:

shutting in a well and connecting a pressure control system and a tool string to an adapted tubing hanger plug;

installing the pressure control system outside a borehole and installing the tool string and the adapted tubing hanger plug into the borehole;

opening the borehole for a fluid flow;

measuring a flow rate of the fluid flow through the borehole using a flowmeter;

measuring physical properties of the fluid flow with sensors on the tool string;

closing a surface safety valve;

retrieving the tool string; and downloading data for analysis of the flow rate and physical properties measured.

2. The method of claim 1, wherein the physical properties measured are a pressure, a temperature, a density, and a fluid phase of the fluid flow.

3. The method of claim 2, wherein the density of the fluid flow is used to determine a water cut.

4. The method of claim 1, wherein a truck-mounted crane is used to lower the tool string into the borehole.

5. The method of claim 1, wherein the flowmeter comprises a fullbore spinner and an inline spinner.

6. The method of claim 1, wherein the adapted tubing hanger plug has a centralized hole to allow full flow with a perforated joint.

7. The method of claim 1, wherein a calibration is performed to determine an average velocity of the fluid flow.

8. The method of claim 1, further comprising extracting the adapted tubing hanger plug and the tool string from the borehole.

9. A system for a tubing hanger deployed apparatus, comprising:

an adapted tubing hanger plug configured to allow full flow through of fluids from a borehole to a surface;

a flowmeter configured to measure a flow rate of a fluid in the borehole;

a pressure control system configured to prevent an uncontrolled flow of liquids from the borehole;

a tool string configured to carry sensors into the borehole;

a plurality of sensors configured to measure pressure data, temperature data, fluid density data, and fluid phase data;

a memory section configured to record the pressure data, the temperature data, the fluid density data, and the fluid phase data; and an electronics section configured to control sensor measurement and recording operations, wherein the electronics section is configured to determine a water cut based on the fluid density data.

10. The system of claim 9, wherein the flowmeter comprises a fullbore spinner and an inline spinner.

11. The system of claim 9, wherein the sensors comprise a pressure sensor, a temperature sensor, a density sensor, and a fluid phase sensor.

12. The system of claim 9, wherein a truck-mounted crane is used to lower the tool string into a borehole.

13. The system of claim 9, further comprising a wireless communication system between a surface facility and the memory section.

14. The system of claim 9, wherein a battery pack supplies power to the sensors.

15. The system of claim 9, wherein the adapted tubing hanger plug is a standard plug adapted to allow a fluid flow through the standard plug.

16. The system of claim 9, wherein the flowmeter is calibrated outside a borehole.

17. The system of claim 9, wherein the adapted tubing hanger plug has a centralized hole to allow a fluid flow with a perforated joint connected below the adapted tubing hanger plug and above the tool string.

18. The system of claim 9, further comprising a winch, wherein the winch at the surface may generate mechanical power and transmit power and communications to the tubing hanger deployed apparatus through a wireline.

19. The system of claim 9, further comprising a programmable controller to control the sensors.

* * * * *